US011421159B2

(12) United States Patent
Pradeep et al.

(10) Patent No.: US 11,421,159 B2
(45) Date of Patent: Aug. 23, 2022

(54) PROCESS AND APPARATUS FOR CO-CONVERSION OF WASTE PLASTICS IN DELAYED COKER UNIT

(71) Applicant: Indian Oil Corporation Limited, Mumbai (IN)

(72) Inventors: Ponoly Ramachandran Pradeep, Faridabad (IN); Terapalli Hari Venkata Devi Prasad, Faridabad (IN); Shivam Ashok Dixit, Faridabad (IN); Prantik Mondal, Faridabad (IN); Vimal Kakkarakkal Kottiyath, Faridabad (IN); Satyen Kumar Das, Faridabad (IN); Anju Chopra, Faridabad (IN); Madhusudan Sau, Faridabad (IN); Gurpreet Singh Kapur, Faridabad (IN); Sankara Sri Venkata Ramakumar, Faridabad (IN); Sanjiv Singh, New Delhi (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 17/005,184

(22) Filed: Aug. 27, 2020

(65) Prior Publication Data

US 2021/0087473 A1 Mar. 25, 2021

(30) Foreign Application Priority Data

Sep. 23, 2019 (IN) ..... 201921038366

(51) Int. Cl.
*C10G 1/10* (2006.01)
*C10G 1/00* (2006.01)

(52) U.S. Cl.
CPC ..... *C10G 1/10* (2013.01); *C10G 1/002* (2013.01); *C10G 2300/1003* (2013.01);
(Continued)

(58) Field of Classification Search
CPC .. C10G 1/10; C10G 1/002; C10G 2300/1003; C10G 2300/202; C10G 2300/206;
(Continued)

(56) References Cited

U.S. PATENT DOCUMENTS 4,118,281 A 10/1978 Yan
2002/0179493 A1 12/2002 Etter
(Continued)

FOREIGN PATENT DOCUMENTS

CN 101230284 A 7/2008
JP 3260436 B2 2/2002
WO 9514069 A1 5/1995

OTHER PUBLICATIONS

Tire Fed Coking Unit, Research Disclosure, Kenneth Mason Publications, Hampshire, UK, GB, No. 448, Aug. 1, 2001 (Aug. 1, 2001), pp. 1365-1357, XP001128212, ISSN: 0374-4353.

*Primary Examiner* — Thuan D Dang
(74) *Attorney, Agent, or Firm* — Workman Nydegger

(57) ABSTRACT

The present invention relates to a process for converting the waste plastic along with the petroleum residue feedstock in a Delayed Coker unit employed in refineries. The invented process aims to convert any type of waste plastic including polystyrene, polypropylene, polyethylene etc. including metal additized multilayer plastics along with the petroleum residue material from crude oil refining such as reduced crude oil, vacuum residue etc. Value added light distillate products like motor spirit, LPG, middle distillates etc. are produced upon co-conversion in the invented process and is recovered and treated along with the products of thermal cracking of hydrocarbon residues. The residual metals in the metal additized plastics upon co-conversion in the invented process will be deposited in the solid petroleum coke.

12 Claims, 5 Drawing Sheets

(52) U.S. Cl.
CPC . *C10G 2300/202* (2013.01); *C10G 2300/206* (2013.01); *C10G 2300/308* (2013.01); *C10G 2300/4006* (2013.01); *C10G 2300/4012* (2013.01); *C10G 2400/06* (2013.01); *C10G 2400/26* (2013.01)

(58) Field of Classification Search
CPC ..... C10G 2300/308; C10G 2300/4006; C10G 2300/4012; C10G 2400/06; C10G 2400/26; C10G 1/00; C10G 9/00; Y02P 20/143; C10B 55/00; C10B 55/02; C10B 53/07; C10L 3/00
See application file for complete search history.

(56) References Cited

U.S. PATENT DOCUMENTS

2014/0197560 A1 7/2014 Frohs et al.
2018/0201847 A1 7/2018 Kohli et al.

PROCESS AND APPARATUS FOR CO-CONVERSION OF WASTE PLASTICS IN DELAYED COKER UNIT

FIELD OF THE INVENTION

The present invention relates to a process for converting the waste plastic along with the petroleum residue feedstock in a Delayed Coker unit employed in refineries.

BACKGROUND OF THE INVENTION

Issue of waste plastic disposal has been a grave concern worldwide and in India in particular, with staggering 6 million tons of waste plastic being generated in India every year. Use of disposal methods such as landfill suffer from issues like groundwater contamination, land use pattern etc. incineration of plastics cause air pollution hampering the health of flora and fauna. Specifically, there is no effective recycling or processing option for metal containing Polyethylene and Polypropylene multi-layer plastics films. With the increased awareness of public regarding cleanliness of public places and waste segregation, it is now becoming increasingly feasible to collect and segregate waste plastics from rest of the waste materials. It is also observed that the liquid and gaseous products of thermal cracking of waste plastics do not meet the complete specifications of end products like gasoline, diesel etc. and require further treatment. This aspect makes a petroleum refinery ideal location for waste plastic conversion since the products of plastic conversion can be fed to the product separation and treatment units along with other hydrocarbon products generated from crude oil. Using the present invention, the collected waste plastics can be co-processed along with residue hydrocarbons in a Delayed Coker Unit and can be converted to useful lighter products.

PCT application WO 95/14069 describes a process for disposal of waste plastics in Delayed Coker process. In said process, the waste plastic is dissolved in a highly aromatic solvent such as furfural in a vessel and the plastic solution is mixed with the feedstock which is processed in Delayed Coker drum in the normal processing route.

US Patent No. 2018/0201847 describes a process for conversion of waste plastics through hydro-treating route. Waste plastics are mixed with heavy crudes and vacuum residues and the resultant mixture is hydro-processed to produce lighter hydrocarbon products.

U.S. Pat. No. 4,118,281 describes a process wherein the waste plastic material is ground into a slurry form and is mixed with the feedstock being processed in the normal process scheme of Delayed Coker unit, passing through fractionator, furnace and coke drums.

It can be seen that in the prior art schemes, the waste plastic material are subjected to size reduction or dissolution in reagents or melting and is routed through furnace and into coke drums thereafter. While these schemes may be advantageous in certain categories of plastics, these may not be suitable for all types of plastics like metal additized plastics. In cases of a mixture of waste plastics containing different types of plastics of varying melting points and metal contents, there is a possibility of non-uniform mixing of components as well as enhanced coke formation inside the Delayed Coker furnace tubes. Metallic components may separate from the rest of the matrix and get deposited in the tube walls of Delayed Coker furnace, or also act as active sites for coke formation inside furnace tubes. Further in schemes where polymer is melted and mixed with feedstock, there can be issues of high viscosity and density difference of polymer melts compared to hydrocarbon feedstocks. This variation in the rheological properties of the hydrocarbon feedstock & polymer melt can cause variation in flow pattern of the two inside the furnace tubes of the Delayed Coker and can cause choking and coking problems of furnace tubes. It is therefore desired to have a process and apparatus addressing the concerns of the prior art.

OBJECTIVES OF THE INVENTION

It is the primary objective of the present invention is to provide the thermal cracking process to convert low value plastic waste material into higher value lighter distillate products in a Delayed Coker unit.

It is the further objective of the present invention is to provide the process for co-conversion of waste plastics along with petroleum residues employing thermal cracking into valuable lighter distillate products.

It is the further objective of the present invention is to provide unique hardware system/apparatus and method to process waste plastics in Delayed Coker unit.

SUMMARY OF THE INVENTION

Accordingly, the present invention provides a method for thermal cracking of waste plastic into lighter distillate products.

1. In one feature, the present invention provides a process for conversion of a waste plastic into lighter distillate products, the process comprising:
   - i. sending a fresh hydrocarbon feedstock into the bottom section of a main fractionator column and drawing out a secondary hydrocarbon feed from the column after mixing with an internal recycle fraction;
   - ii. feeding the secondary hydrocarbon feed after heating in a furnace to a delayed coker drum;
   - iii. loading the waste plastic into a supply vessel
   - iv. conveying the waste plastic from the supply vessel to the delayed coker drum and then thermal cracking a mixture of the secondary feed and the waste plastic to obtain a combined product vapor inside the coke drum;
   - v. routing the combined product vapor to a main fractionator column to obtain a light coker gasoil, a heavy coker gasoil and a coke fuel oil along with a vapor fraction;
   - vi. sending the vapor fraction to a gas concentration (GASCON section) and separation section for separating into fuel gas, LPG and naphtha.

In another feature of the present invention, the waste plastics are supplied from the plastic feeder vessel to the coke drum by using a conveyer such as screw conveyer.

In another preferred feature of the present invention, the waste plastic material is kept in the plastic feeder vessel in the molten form by application of heat and is supplied to the coke drum in liquid form.

In yet another feature of the present invention, the waste plastic transport from the waste plastic supply vessel to the coke drums is carried out by means selected from pneumatic transport, extrusion or melt injection or combination thereof.

In yet another feature of the present invention, the waste plastic is selected from the group consisting of polystyrene, polypropylene, polyethylene, PET including metal additized multilayer plastics or combination thereof.

In yet another feature of the present invention, the physical form of waste plastic is selected from the group consisting of granules, powder, crushed chunks, slurry, melt or combination thereof.

In another feature of the present invention, percentage of waste plastic in comparison with the hydrocarbon feedstock supplied is in the range of 0.01 to 50 wt % preferably between 0.5 to 10 wt %.

In one feature of the present invention, the hydrocarbon feedstock is selected from crude oil, vacuum residue, atmospheric residue, deasphalted pitch, shale oil, coal tar, clarified oil, residual oils, heavy waxy distillates, foots oil, slop oil or mixture thereof.

The process as claimed in claim 1, wherein the conradson carbon residue content of the hydrocarbon feedstock is in the range of 3 to 30 wt % and density in the range of 0.95 to 1.08 g/cc.

In another feature of the present invention, thermal cracking section of the process is operated at a higher severity with desired operating temperature ranging from 470 to 520° C., preferably between 480° C. to 500° C. and desired operating pressure ranging from 0.5 to 5 $Kg/cm^2$ (g) preferably between 0.6 to 3 $Kg/cm^2$ (g).

In yet another feature of the present invention, the secondary feed in step (ii) is heated at a temperature in the range of 470 to 520° C.

In further feature of the present invention, cycle time of the coking and decoking cycles of the coke drums are more than 10 hr.

In another feature of the present invention, product vapors from the coke drums are routed to the main fractionator column for separation into different product fractions like Light Coker Gasoil, Heavy Coker Gasoil, and Coker Fuel Oil.

In further feature of the present invention, the vapor fractions are sent to the Gas concentration and separation section for separation of fuel gas, LPG and naphtha.

In another feature of the present invention, comprises a system for conversion of a waste plastic into light distillate products, the system including coke drums in the delayed coking process, fractionators column connected to the coke drums, and a add-on section(s)/supply vessel(s).

The present invention also provides an apparatus for conversion of a waste plastic into light distillate products, the system comprising:

(a) a main fractionator column to
  route a fresh hydrocarbon feed with an internal recycle fraction to obtain a secondary feed;
(b) a furnace connected to the main fractionator column to heat the secondary feed to obtain a hot feed;
(c) a waste plastic supply vessel to
  to supply a fluidized waste plastic material to a delayed coker drum;
(d) the delayed coker drum connected to the furnace and to the waste plastic supply vessel to
  receive the hot feed from the furnace;
  receive the waste plastic material from the plastic supply vessel
  thermal decomposition/cracking of mixture of the hot feed and the waste plastic material to obtain a combined product vapor; and
  rout the combined product vapor to the to the main fractionator column to obtain light coker gasoil, heavy coker gasoil and coker fuel oil along with a vapor fraction, and
(e) a gas concentration and separation section connected to the main fractionator column to separate the vapor fraction into
  fuel gas, LPG and naphtha.

In one feature of the present invention, the waste plastic supply vessel is located at higher elevation than coke drums to enable smooth flow of plastics to the coke drums.

In another feature of the present invention, the waste plastic is conveyed into the waste plastic supply vessel from another unloading vessel located at lower elevation compared to the waste plastic supply vessel through pneumatic transport or through conveyer belts.

In yet another feature of the present invention, the waste plastic from waste plastic supply vessel is conveyed to Coke Drums by means of either pneumatic transport, screw feeder, melt injection or combination of both.

In yet another feature of the present invention, the waste plastic supply vessel has facility for rousing gas injection and purging.

In yet another feature of the present invention, the waste plastic supply vessel optionally has facility for heating and melting of waste plastics.

In yet another feature of the present invention, the waste plastic supply rate from the waste plastic supply vessel is controlled by means of rotary airlock valve or pump.

In yet another feature of the present invention, the waste plastic supply vessel is kept under pressure higher than the coke drums, controlled by means of pressure control valve, in the range of 0.1 to 1 $Kg/cm^2g$.

The present invention also provides an apparatus for conversion of a waste plastic into light distillate products, the system comprising:

(a) a main fractionator column (2,41,101,201) to
  route a fresh hydrocarbon feed (1, 40, 100, 200) with an internal recycle fraction to obtain a secondary feed (3,42,102,202);
(b) a furnace (4, 43, 103, 203) connected to the main fractionator column to
  heat the secondary feed to obtain a hot feed (5, 44, 104, 204);
(c) a waste plastic supply vessel (13, 22, 52, 81, 108, 207) to
  to supply a fluidized waste plastic material to a delayed coker drum (9, 10, 48, 49, 90, 105, 106, 205, 206)
(d) the delayed coker drum (9, 10, 48, 4990, 105, 106, 205, 206) connected to the furnace (4, 43, 103, 203) and to the waste plastic supply vessel (13, 22,52, 81, 108, 207) to
  receive the hot feed from the furnace;
  receive the waste plastic material from the plastic supply vessel
  thermal decomposition/cracking of mixture of the hot feed and the waste plastic material to obtain a combined product vapor (21, 63, 92, 107, 214); and
  rout the combined product vapor to the to the main fractionator column to obtain light coker gasoil (31, 66, 110, 216), heavy coker gasoil (32, 65, 111,217) and coker fuel oil (33, 64,112, 218) along with a vapor fraction (35, 67, 113, 215), and
(e) a gas concentration and separation section connected to the main fractionator column to separate the vapor fraction into
  fuel gas, LPG and naphtha.

In one feature of the present invention, the waste plastic supply vessel (13, 22, 52, 81, 108, 207) is located at higher elevation than coke drums to enable smooth flow of plastics to the coke drums.

In another feature of the present invention, the waste plastic is conveyed into the waste plastic supply vessel (13, 22, 52, 81, 108, 207) from another unloading vessel (71) located at lower elevation compared to the waste plastic supply vessel through pneumatic transport or through conveyer belts.

In yet another feature of the present invention, the waste plastic from waste plastic supply vessel (13, 22, 52, 81, 108, 207) is conveyed to Coke Drums by means of either pneumatic transport, screw feeder, melt injection or combination of both.

In yet another feature of the present invention, the waste plastic supply vessel (13, 22, 52, 81) has facility for rousing gas injection and purging.

In yet another feature of the present invention, the waste plastic supply vessel (108, 207) optionally has facility for heating and melting of waste plastics.

In yet another feature of the present invention, the waste plastic supply rate from the waste plastic supply vessel (13, 22, 52, 81) is controlled by means of rotary airlock valve or pump.

In yet another feature of the present invention, the waste plastic supply vessel (13, 22, 52, 81, 108, 207) is kept under pressure higher than the coke drums, controlled by means of pressure control valve, in the range of 0.1 to 1 $Kg/cm^2g$.

DETAILED DESCRIPTION OF THE INVENTION

Figure 1:
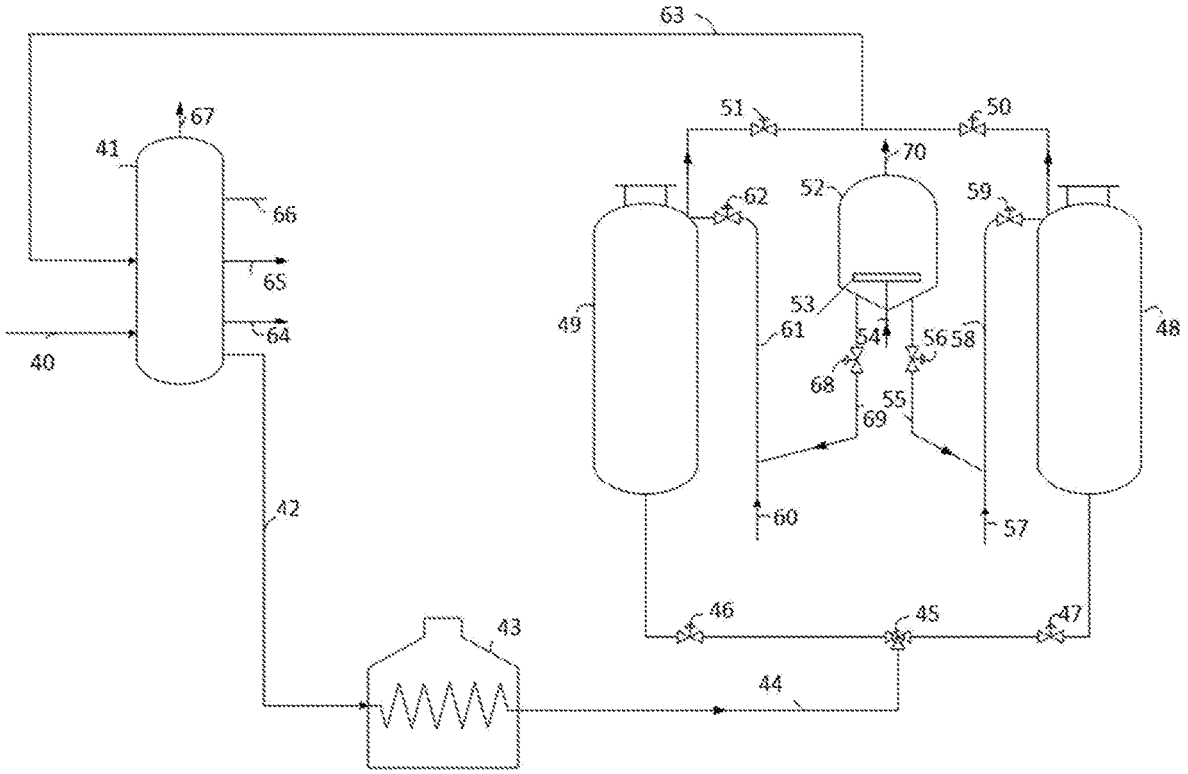
FIG. 1: illustrates one process scheme of present invention.

Accordingly, present invention relates to a process to convert low value plastic waste material into higher value lighter distillate products like Fuel gas, LPG, naphtha, Light Coker Gasoil (LCGO), Heavy Coker Gasoil (HCGO) and Coker Fuel Oil (CFO) etc. along with solid petroleum coke by thermally cracking the same in a Delayed Coker unit along with hydrocarbon feedstock.

In detail, the invented process employs a unique process hardware scheme to feed the waste plastic into the coke drums directly without impacting the operation of other critical hardware like Furnace, which is susceptible to fouling, if there is impurities like metals, particles etc. in the feedstock being heated. The crushed waste plastic material is loaded into a fluidized feeder vessel and is supplied pneumatically to the coke drums through pneumatic conveying mechanism after the drum heating step is completed. Inside the coke drum, it undergoes co-conversion along with the hot petroleum residue stream which is being supplied from the bottom of the coke drum.

Lighter distillates generated while thermal co-conversion in the vapor form inside the coke drum gets mixed with product vapors generated from thermal cracking of hydrocarbon feedstock and the combined product vapor is then routed to the main fractionator column to separate into desired liquid product fractions like light coke gasoil, heavy coke gasoil and coke fuel oil. The off-gases from the fractionator column overhead section are routed to the GASCON section for separation of naphtha, Fuel gas and LPG. The residue coke materials produced during the conversion of waste plastic will be deposited along with solid petroleum coke formed inside the coke drum due to thermal cracking of hydrocarbon feedstock. The metals in the waste plastics are mostly not in organo-metallic form and therefore are deposited preferentially in solid petroleum coke inside coke drum.

Feedstock:

The liquid hydrocarbon feedstock to be used in the process is selected from heavy hydrocarbon feedstocks like reduced crude oil, vacuum residue, atmospheric residue, deasphalted pitch, shale oil, coal tar, clarified oil, residual oils, heavy waxy distillates, foots oil, slop oil or blends of such hydrocarbons. The Conradson carbon residue content of the feedstock is above 3 wt % and minimum density of 0.95 g/cc.

Waste Plastic:

Plastics are macromolecules, formed by polymerization and having the ability to be shaped by application of reasonable amount of heat and pressure or another form of forces. Plastic is a generic term for a wide range of polymers produced using highly refined fractions of crude oil, or chemicals derived from crude oil, known as monomers. Polymers are formed by the reaction of these monomers, which results in chain lengths of tens or hundreds of thousands of carbon atoms. Some polymers also contain oxygen (e.g. polyethylene terephthalate (PET)), whereas others contain chlorine (polyvinyl chloride (PVC)). Due to its non-biodegradable nature, the
plastic waste contributes significantly to the problem of waste management.

Plastics, depending upon their physical properties may be classified into thermoplastic or thermosetting plastic materials.

- Thermoplastic materials (Recyclable Plastics): These can be formed into desired shapes under heat and pressure and become solids on heating. Examples are Polythene, Polystyrene and PVC.
- Thermostats or Thermosetting materials (Non-Recyclable Plastics): These, once shaped, cannot be softened/remolded by the application of heat. Examples are phenol formaldehyde and urea formaldehyde.
- The waste plastics which can be co-converted in the invented process includes a variety of plastics comprising polystyrene, polypropylene, polyethylene, PET etc. including metal additized multilayer plastics. These waste plastics to be used in the process can be pre-processed by steps comprising of washing, drying, extrusion, pelletization etc. In order to enable transfer of the same from plastic feeder vessel to the Coke drum. The waste plastics can be prepared with selected size and shape specifications to enable them to be in fluidizable form for enabling pneumatic transport.

In one feature of the present invention, the waste plastics are supplied from the plastic feeder vessel to the coke drum by using a conveyer such as screw conveyer.

In another feature of the present invention, the waste plastic material is kept in the plastic feeder vessel in the molten form by application of heat and is supplied to the coke drum in liquid form.

In yet another feature of the invention, the waste plastics used for processing in the process of present invention can be in crushed form or as lumps which can be transported through other means like conveyer belts.

Process Conditions:

Reactor drums in the thermal cracking section of the process may be operated at a higher severity with desired operating temperature ranging from 470 to 520° C., preferably between 480° C. to 500° C. and desired operating pressure ranging from 0.5 to 5 $Kg/cm^2$ (g) preferably between 0.6 to 3 $Kg/cm^2$ (g). The cycle time of the coking and decoking cycles of the coke drums are kept more than 10 hr. The waste plastic material can be fed to the coke drum such as the percentage of waste plastic in comparison with the hydrocarbon feedstock supplied is in the range of 0.01 to 50 wt % preferably between 0.5 to 10 wt %.

Process Description:

The process of the present invention is exemplified by, but not limited to FIG. 1. In the process described in FIG. 1, the hydrocarbon feed (40) from the refinery enters the bottom of the main fractionator column (41) and is mixed with the internal recycle fraction to make the secondary feed (42). The secondary feed is then heated in a furnace (43) to the desired temperature. The hot feed (44) is then sent to a Delayed Coker drum (49, 48) whichever is in the hydrocarbon feeding cycle, through operation of appropriate valves (45, 46, and 47). Meanwhile, the waste plastic material from a fluidized plastic supply vessel (52) is pneumatically sent to the coke drum under feeding cycle. The hot residue feed is mixed with the waste plastic material supplied in the coke drum and thermal conversion happens for the residue feedstock as well as the waste plastic material. The plastic material is thermally decomposed into lighter molecules. The waste plastics in the supply vessel (52) are kept in fluidized condition by supply of fluidizing medium like air (54) sent through a distributor (53). The flow of plastic material through the standpipes (69, 59) is controlled by control valves (68, 56) which can be rotary airlock valves. Depending upon to which drum the plastic material is to be sent, the valves (68, 69, 62, 59) are operated. To assist in pneumatic conveying, fluid transport media (60, 57) are provided in the lift lines (58, 61) for waste plastics. The product vapors (63) from the coke drums are routed to the main fractionator column (41) for separation into different product fractions like Light Coker Gasoil (66), Heavy Coker Gasoil (65), and Coker Fuel Oil (64). The vapor fraction (67) is sent to the Gas concentration and separation section for separation of fuel gas, LPG and naphtha.

Figure 2:
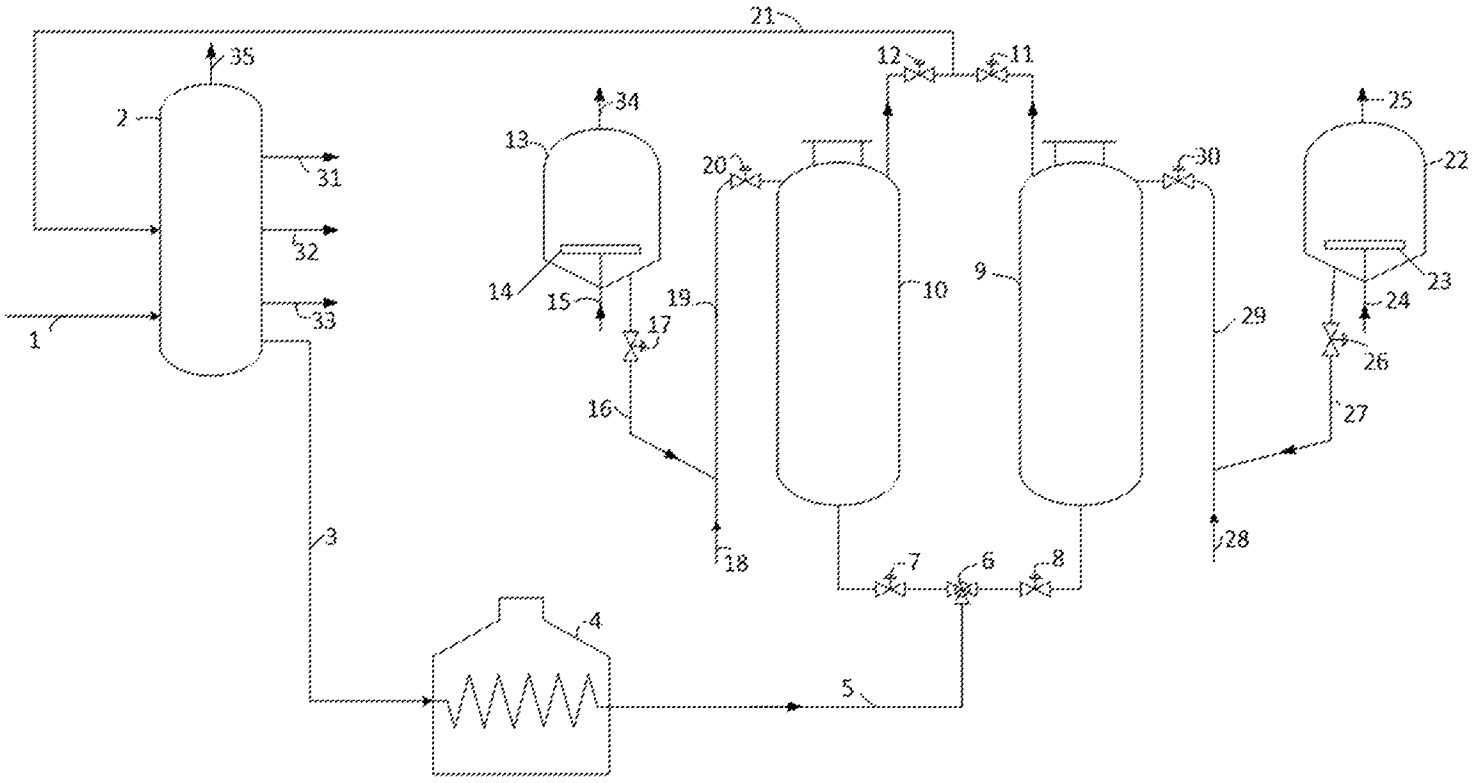
FIG. 2: illustrates second process scheme of present invention.

The embodiment of the process of the present invention is exemplified by, but not limited to FIG. 2. In the process described in FIG. 2, the hydrocarbon feed (1) from the refinery enters the bottom of the main fractionator column (2) and is mixed with the internal recycle fraction to make the secondary feed (3). The secondary feed is then heated in a furnace (4) to the desired temperature. The hot feed (5) is then sent to a Delayed Coker drum (9, 10) whichever is in the hydrocarbon feeding cycle, through operation of appropriate valves (6, 7, 8) which can be rotary airlock valves. Meanwhile, the waste plastic material from a fluidized plastic supply vessel (13, 22) is pneumatically sent to the coke drum under feeding cycle. The hot residue feed is mixed with the waste plastic material supplied in the coke drum and thermal conversion happens for the residue feedstock as well as the waste plastic material. The plastic material is thermally decomposed into lighter molecules. The waste plastics in the supply vessels (13, 22) are kept in fluidized condition by supply of fluidizing medium like air (15, 24) sent through a distributor (14, 23). The flows of plastic material through the standpipes (16, 27) are controlled by control valves (17, 26) which can be rotary airlock valves. Depending upon to which drum the plastic material is to be sent, the valves (17, 20, 26, 30) are operated. To assist in pneumatic conveying, fluid transport media (18, 28) are provided in the lift lines (19, 29) for waste plastics. The product vapors (21) from the coke drums are routed to the main fractionator column (2) for separation into different product fractions like Light Coker Gasoil (31), Heavy Coker Gasoil (32) and Coker Fuel Oil (33). The vapor fraction (35) is sent to the Gas concentration and separation section for separation of fuel gas, LPG and naphtha.

Figure 3:
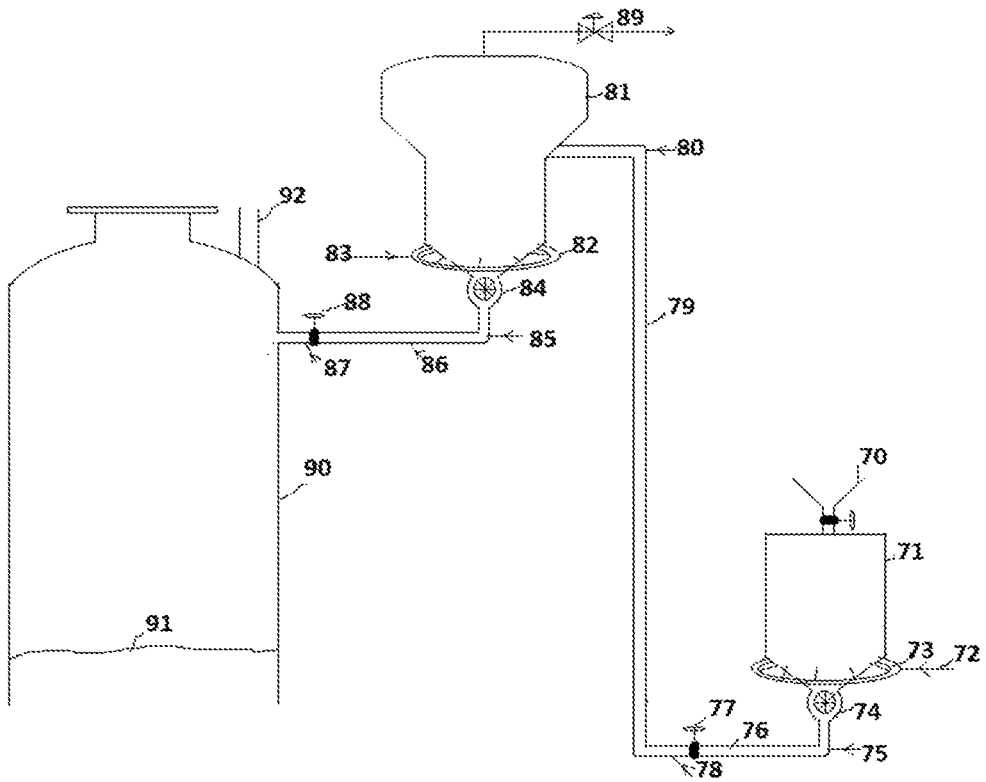
FIG. 3: illustrates process for co-conversion of waste plastic in delayed coker unit in accordance with another feature of the invention.

One embodiment of the invention depicting plastic processing hardware and process is provided in FIG. 3. In the process and hardware section descripted in said figure, the waste plastic granules are unloaded into the unloading vessel (71) through a hopper (70), inside which a rousing gas (72) is supplied through a header (73). The plastic is withdrawn at a controlled rate through the rotary airlock valve (74) and is pushed by a conveying gas (75) through a horizontal conveying line (76) which then moves vertically (79) to convey the plastic granules into the supply vessel (81) located at a higher elevation compared to the unloading vessel (71). Isolation valve (77) and purges (78, 80) are provided in the conveying gas line for additional purging and transport. Inside which a rousing gas (72) is supplied through a header (73). The supply vessel (81) is kept under controlled pressure through PCV (89). The plastic is withdrawn from the supply vessel (81) at a controlled rate through the rotary airlock valve (84) and is pushed by a conveying gas (85) through a horizontal conveying line (86) to convey the plastic granules into the coke drum (90). Purge flows (87) can be provided in the conveying line and isolation valve (88) in the conveying line. The waste plastic granules fall into the hot liquid pool (91) where it cracks into lighter products and the product vapor goes out through the vapor line (92).

Figure 4:
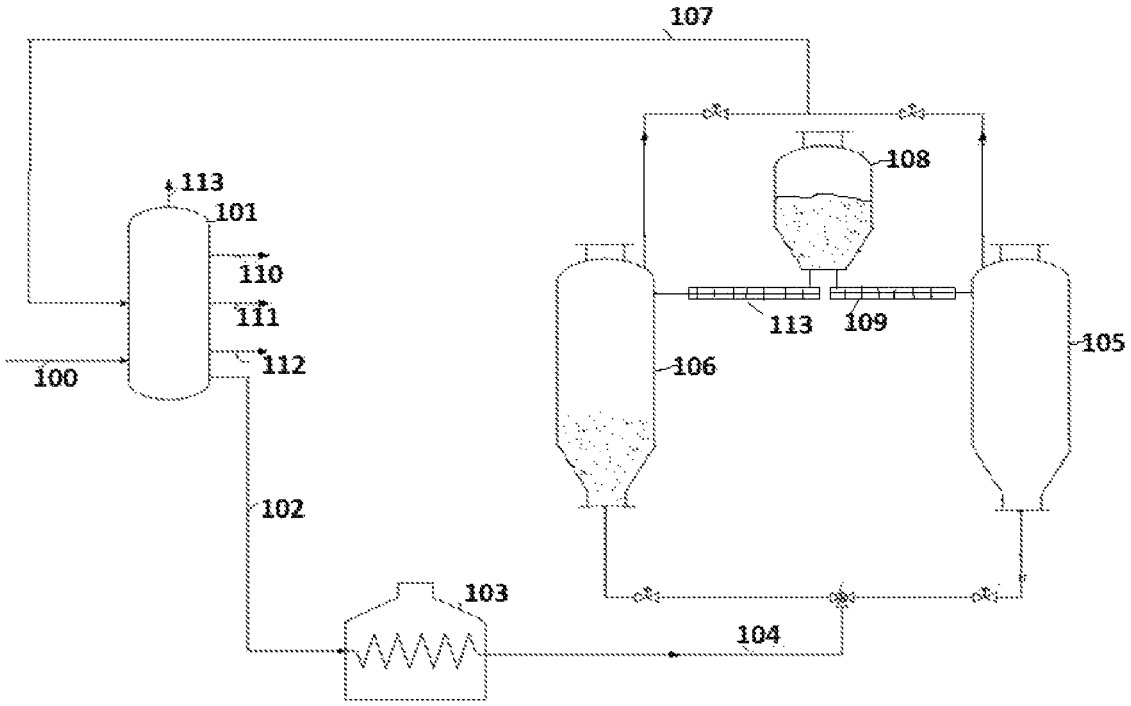
FIG. 4: illustrates process for co-conversion of waste plastic in delayed coker unit in accordance with another feature of the invention.

In another embodiment of invention depicting the plastic processing hardware and process is provided in FIG. 4. In the process and hardware section descripted in said figure, the waste plastic will be carried into the plastic supply vessel (108) in granule or crushed form from where, the plastic is carried into the heated screw conveyers (109, 113) wherein the plastic particles are melted and supplied into the coke drums (105, 106) which is in feeding cycle. The fresh feed (100) is supplied into the fractionator column (101) and the secondary feed (102) is withdrawn and is routed through the Furnace (103) to get the hot feed (104). The hot feed is then routed to the coke drums (105, 106) whichever is in the feeding cycle. Inside the coke drum in the feeding cycle, both the hydrocarbon hot feed as well as the plastic supplied through screw conveying mixes and the waste plastic gets thermally cracked into lighter hydrocarbon molecules. The product vapors are routed through overhead product vapor line (107) to the fractionator column (101) where the products are separated into off-gas with unstabilized naphtha (113), LCGO (110), HCGO (111) and CFO (112). Coke deposited inside the coke drums are removed by cutting using high pressure water jets after opening of flange in maintenance cycle.

Figure 5:
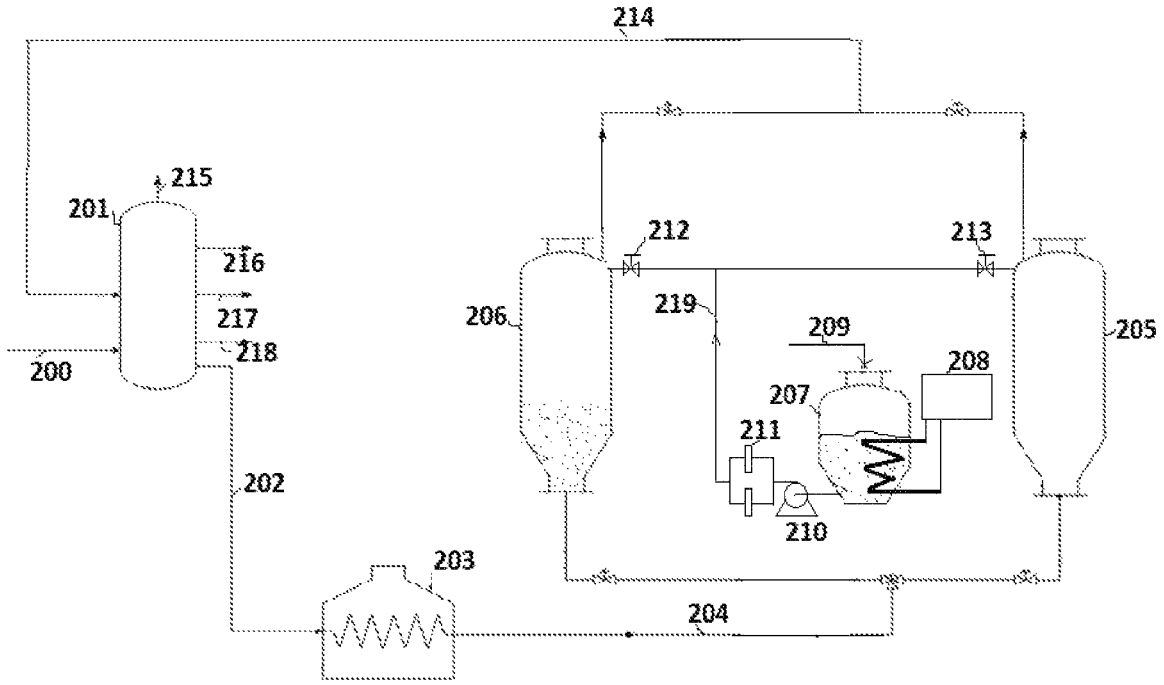
FIG. 5: illustrates process for co-conversion of waste plastic in delayed coker unit in accordance with another feature of the invention.

In yet another embodiment of the invention depicting plastic processing hardware and process is provided in FIG. 5. In the process and hardware section descripted in said figure, the waste plastic is loaded into the plastic supply vessel (207) wherein the plastic supplied (209) into the vessel is heated using a heating source (208) which can be either electrical or by a hot stream like superheated steam. The plastic supply (209) may be also mixed with a diluent stream for facilitating easy melting and transport. The molten liquid or slurry is pumped using a pump (210) and strained by using strainers (211) before supplying into the coke drums (205, 206) through a supply line (219). Isolation valves (212, 213) are provided in the plastic supply lines. The fresh feed (200) is supplied into the fractionator column (201) and the secondary feed (202) is withdrawn and is routed through the Furnace (203) to get the hot feed (204). The hot feed is then routed to the coke drums (205, 206) whichever is in the feeding cycle. Inside the coke drum in the feeding cycle, both the hydrocarbon hot feed as well as the plastic supplied through screw conveying mixes and the waste plastic gets thermally cracked into lighter hydrocarbon molecules. The product vapors are routed through overhead product vapor line (214) to the fractionator column (201) where the products are separated into off-gas with unstabilized naphtha (215), LCGO (216), HCGO (217) and CFO (218). Coke deposited inside the coke drums are removed by cutting using high pressure water jets after opening of flange in maintenance cycle.

Examples

The process of present invention is exemplified by following non-limiting examples.

Vacuum reside feedstock was arranged from petroleum refinery and characterization was carried out. The properties of the vacuum residue feedstock are provided in Table-1.

TABLE 1

Properties of vacuum residue feedstock

| Property | Value |
|---|---|
| Density @ 15° C., g/cm$^3$ | 1.031 |
| CCR, wt % | 22.44 |
| Asphaltene, wt % | 8.52 |
| Sulfur, wt % | 4.40 |
| Distillation (ASTM D2887) 10/20/50 | 432/538/594 |

Experiments conducted in Micro-Coker unit with waste granules of LDPE (Low Density Polyethylene), HDPE (High Density Polyethylene), Mix Plastic and the vacuum residue. The mixing of the waste plastics and the vacuum residue feedstock was inside the Micro-Coker reactor. The operating conditions of the reaction section maintained for the experiments are provided in Table-2.

TABLE 2

Operating conditions of Micro-Coker reactor unit

| Operating Conditions | Value |
|---|---|
| Temperature, ° C. | 486-488 |
| Pressure, Kg/cm$^2$g | 1.8-2.1 |

The product yields obtained in different experiments by co-processing of plastics with vacuum residue are provided in Table-3.

TABLE 3

Product yield data from experiments

| | VR | VR + LDPE | | | VR + HDPE | | | VR + Mixed Waste | | |
|---|---|---|---|---|---|---|---|---|---|---|
| Run Number | 1 | 2 | 3 | 4 | 5 | 6 | 7 | 8 | 9 | 10 |
| Waste plastic dosing, wt % | 0 | 10 | 20 | 40 | 10 | 20 | 40 | 10 | 20 | 40 |
| Gas yield, wt % | 21.5 | 16.06 | 17.11 | 12 | 18.12 | 19.29 | 28.46 | 18.26 | 15.31 | 25.86 |
| Liquid yield, wt % | 44.3 | 54.89 | 58.1 | 68.6 | 56.38 | 55.11 | 54.03 | 57.56 | 62.55 | 56.46 |
| Coke yield, wt % | 34.2 | 29.04 | 24.78 | 19.4 | 25.49 | 25.59 | 17.5 | 24.16 | 22.12 | 17.66 |

It can be seen from the experimental data provided in Table-3 that the waste plastics have converted to gaseous and liquid fractions while co-processing.

Further, experiments were carried out using vacuum residue feedstock of Table-1 and multilayer metal additized waste plastic granules with properties provided in Table-4, in a Delayed Coker pilot plant of 1 barrel per day capacity.

TABLE 4

Properties of multilayer metal additized waste plastic granule

| | |
|---|---|
| Composition | Mix of PE, PP, PET (multilayer) |
| Form | Granules of cylindrical shape |
| Size, mm | 2 |
| Bulk density, Kg/m$^3$ | 507 |
| Particle density, Kg/m$^3$ | 923 |
| Melting temperature, ° C. | 122° C. onwards |
| Metal by ICAP, ppmw Al/Ca | 601/2583 |

Experimental conditions are provided in Table-5. Waste plastic granules are directly supplied to the Coke Drum bypassing the furnace, where it cracks to lighter hydrocarbon products.

TABLE 5

Operating conditions of DCU Pilot Plant experiments

| Operating Condition | Value |
|---|---|
| Feed rate, kg/hr | 8 |
| Drum inlet temp, ° C. | 486 |
| Coke drum pressure, kg/cm$^2$g | 1.0 |
| Recycle ratio | 0 |
| Waste plastic dosing, wt % | 2.2 |
| Cycle time, hrs | 12 |

Two experiments were carried out—with and without dosing of waste plastic to the Drum. The results of experiments are provided in Table-6. It can be seen that the additionally input waste plastic has converted to different product fractions as can be seen from the Kg/cycle of product formation from waste plastic.

TABLE 6

DCU Pilot Plant yields with Feed-1 & Waste plastic

| | Without Waste plastic dosing | With 2.2% waste plastic (additional) | Δyields | |
|---|---|---|---|---|
| Product yields | wt % | wt % | wt % | Kg/cycle |
| FG | 5.5 | 5.43 | −0.07 | 0.047 |
| LPG | 5.94 | 5.84 | −0.1 | 0.027 |

TABLE 6-continued

DCU Pilot Plant yields with Feed-1 & Waste plastic

| Product yields | Without Waste plastic dosing wt % | With 2.2% waste plastic (additional) wt % | Δyields wt % | Δyields Kg/cycle |
|---|---|---|---|---|
| Coker Naphtha | 10.99 | 11.08 | 0.09 | 0.320 |
| LCGO | 29.28 | 29.53 | 0.25 | 0.864 |
| HCGO | 20.57 | 20.52 | −0.05 | 0.385 |
| CFO | 1.02 | 1 | −0.02 | 0.002 |
| Coke | 26.7 | 26.6 | −0.1 | 0.466 |

A comparison of coke properties are provided in Table-7. It can be seen that the metal content in the waste plastic has deposited in the coke which is formed during the Delayed Coking reaction and therefore the ash content has increased. The liquid products are devoid of any additional metal due to waste plastic processing.

TABLE 7

Comparison of coke properties due to plastic processing

| Coke Property | Base case (without plastic) | With plastic processing (2 wt %) |
|---|---|---|
| Sulfur, wt % | 5.1 | 5.1 |
| Volatile matter, wt % | 9.68 | 9.71 |
| Moisture Content, wt % | 0.23 | 0.2 |
| Ash content, wt % | 0.28 | 0.46 |
| Fixed Carbon, wt % | 89.43 | 89.3 |

Advantages of the Present Invention

The following are the technical advantages of the present invention over the prior art as disclosed above:

- uses an add-on hardware section in existing Delayed Coker unit hardware to enable direct feeding of waste plastics into the coke drum to convert the waste plastics into valuable lighter distillate products
- enables the refiner to process waste plastic without any need for reducing the hydrocarbon feed throughput through the Coker Furnace
- enables the refiner to generate value from the low cost waste plastics and also address the environmental concerns of waste plastic disposal
- ensures that there is no incremental coke deposition inside the Delayed Coker furnace due to processing of waste plastics including metal additized plastics
- residual metallic fraction of the metal additized plastics get deposited in the solid petroleum coke generated in the Delayed Coking process

The invention claimed is:

1. A process for co-conversion of a waste plastic material along with hydrocarbons into lighter distillate products, the process comprising:

a. sending a fresh hydrocarbon feedstock into a bottom section of a main fractionator column and drawing out a secondary hydrocarbon feed from the main fractionator column after mixing with an internal recycle fraction, wherein the fresh hydrocarbon feedstock is selected from the group consisting of crude oil, vacuum residue, atmospheric residue, deasphalted pitch, shale oil, coal tar, clarified oil, residual oils, heavy waxy distillates, foots oil, slop oil, and a mixture thereof, wherein the secondary feed is heated in a furnace to obtain a hot feed;

b. feeding the hot feed into a bottom section of a delayed coker drum;

c. loading the waste plastic material into a supply vessel, wherein the waste plastic material is aluminum or calcium additized multilayer plastic and is selected from a group consisting of, polypropylene, polyethylene, PET (polyethylene terephthalate), and a combination thereof, wherein the waste plastic material is present in a range of 0.01 to 50 wt % of the fresh hydrocarbon feedstock, wherein the waste plastic supply vessel is located at a higher elevation than the delayed coker drum to enable smooth flow of waste plastics to the delayed coker drum, and wherein the waste plastic material is in granule, powder or crushed chunks form;

d. conveying the waste plastic material from the supply vessel directly to the delayed coker drum bypassing the furnace and then thermally cracking a mixture of the hot feed and the waste plastic material to obtain a combined product vapor and a solid petroleum coke inside the delayed coker drum, wherein the aluminum or the calcium of the waste plastic material is deposited in the solid petroleum coke;

e. routing the combined product vapor to the main fractionator column to obtain a light coker gasoil (LCGO), a heavy coker gasoil (HCGO) and a coke fuel oil (CFO) along with a vapor fraction; and f. sending the vapor fraction to a gas concentration (GASCON section) and separation section for separating into fuel gas (FG), LPG, and coker naphtha.

2. The process as claimed in claim 1, wherein conveying the waste plastic from the supply vessel to the delayed coker drums is carried out by pneumatic transport, extrusion, melt injection or a combination thereof.

3. The process as claimed in claim 1, wherein Conradson carbon residue content of the fresh hydrocarbon feedstock is in a range of 3 to 30 wt % and density is in a range of 0.95 to 1.08 g/cc.

4. The process as claimed in claim 1, wherein the conversion of the waste plastic material into lighter distillate products occurs at a temperature in a range of 470° C. to 520° C. and a pressure in a range of 0.5 to 5 Kg/cm$^2$.

5. The process as claimed in claim 1, wherein the secondary hydrocarbon feed in step (a) is heated at a temperature in a range of 470° C. to 520° C.

6. An apparatus for co-conversion of a waste plastic material along with the hydrocarbons into light distillate products, the apparatus comprising:

(a) a main fractionator column configured to
route a fresh hydrocarbon feedstock with an internal recycle fraction to obtain a secondary feed, wherein the fresh hydrocarbon feedstock is selected from the group consisting of crude oil, vacuum residue, atmospheric residue, deasphalted pitch, shale oil, coal tar, clarified oil, residual oils, heavy waxy distillates, foots oil, slop oil, and a mixture thereof;

(b) a furnace connected to the main fractionator column, wherein the furnace is configured to
heat the secondary feed to obtain a hot feed;

(c) a waste plastic supply vessel configured to
supply the waste plastic material directly to a delayed coker drum bypassing the furnace, wherein the waste plastic material is aluminum, or calcium additized multilayer plastic and is selected from a group consisting of polypropylene, polyethylene, PET (polyethylene terephthalate), and a combination thereof, wherein the waste plastic material is present in a range of 0.01 to 50 wt % of the fresh hydrocarbon feedstock, wherein the waste plastic supply vessel is located at a higher elevation than the delayed coker drum to enable smooth flow of waste plastics to the delayed coker drum, and wherein the waste plastic material is in granule, powder or crushed chunks form;

wherein the delayed coker drum is connected to the furnace and to the waste plastic supply vessel, wherein the delayed coker drum is configured to receive the hot feed from the furnace;

to receive the waste plastic material from the plastic supply vessel;

to thermally decompose or crack a mixture of the hot feed and the waste plastic material to obtain a combined product vapor and solid petroleum coke inside the delayed coker drum, the aluminum or the calcium of the waste plastic material is deposited in the solid petroleum coke; and to route the combined product vapor to the main fractionator column to obtain light coker gasoil (LCGO), heavy coker gasoil (HCGO), and coker fuel oil (CFO) along with a vapor fraction;

(d) a gas concentration (GASCON section) and separation section connected to the main fractionator column, wherein the gas concentration and separation section is configured to separate the vapor fraction into fuel gas (FG), LPG, and coker naphtha.

7. The apparatus as claimed in claim 6, wherein the waste plastic material is conveyed into the waste plastic supply vessel from another unloading vessel located at a lower elevation compared to the waste plastic supply vessel through pneumatic transport or through conveyer belts.

8. The apparatus as claimed in claim 6, wherein the waste plastic material from the waste plastic supply vessel is conveyed directly to the delayed coker drum by a means selected from pneumatic transport, screw feeder, melt injection or combination thereof.

9. The apparatus as claimed in claim 6, wherein the waste plastic supply vessel has a facility for rousing gas injection and purging.

10. The apparatus as claimed in claim 6, wherein the waste plastic supply vessel has a facility for heating and melting of the waste plastics material.

11. The apparatus as claimed in claim 6, further comprises a rotary airlock valve or a pump configured to control a rate at which the waste plastic material is supplied to the waste plastic supply vessel.

12. The apparatus as claimed in claim 6, further comprises a pressure control valve, wherein the pressure control valve is configured to maintain a pressure in the waste plastic supply vessel, wherein the pressure in the waste plastic supply vessel is 0.1 to 1 $Kg/cm^2g$ higher than a pressure of the delayed coker drum, wherein the delayed coker drum has a pressure in a range from 0.5 to 5 $Kg/cm^2$.

* * * * *